United States Patent [19]

Rüegg et al.

[11] Patent Number: 4,764,106

[45] Date of Patent: Aug. 16, 1988

[54] BURNER FOR USE IN A ROTARY DRUM OF A COMBUSTION FURNACE

[75] Inventors: Hans Rüegg, Wohlen; Walter Tschantré, Zurich, both of Switzerland

[73] Assignee: Von Roll AG, Gerlafingen, Switzerland

[21] Appl. No.: 792,914

[22] Filed: Oct. 30, 1985

[30] Foreign Application Priority Data

Nov. 5, 1984 [CH] Switzerland ..... 5297/84

[51] Int. Cl.[4] ..... F23D 11/36

[52] U.S. Cl. ..... 431/160; 431/284

[58] Field of Search ..... 431/160, 187, 190, 284; 122/6.5, 6.6; 432/174, 103; 110/246

[56] References Cited

U.S. PATENT DOCUMENTS

| | | | |
|---|---|---|---|
| 2,335,188 | 11/1943 | Kennedy | 431/284 X |
| 2,457,304 | 12/1948 | Crowe | 431/160 |
| 4,350,102 | 9/1982 | Ruegg | 110/246 |

FOREIGN PATENT DOCUMENTS

| | | | |
|---|---|---|---|
| 2118409 | 4/1973 | Fed. Rep. of Germany | 431/160 |
| 0070310 | 4/1982 | Japan | 431/160 |
| 0855343 | 8/1981 | U.S.S.R. | 431/160 |

*Primary Examiner*—Margaret A. Focarino

*Attorney, Agent, or Firm*—Bachman & LaPointe

[57] ABSTRACT

In a burner, particularly for use in a drum of a combustion furnace or incinerator for flowable, pump-deliverable waste materials, a lance is provided for introducing the fuel and a nozzle is placed on the end thereof. The lance can be surrounded by a first uncooled lining, which essentially comprises two tubular, coaxial jacket parts. The first lining is surrounded by a second lining, which once again comprises two jacket parts. The combustion air for the additional fuels in the incinerator (e.g. barrels, etc.) is introduced into the incinerator between the two linings, while the burner air enters in the vicinity of the nozzle in the first lining between the two jacket parts. Thus, important media for the actual combustion process can be directly introduced to the burning point within the incinerator via the burner.

11 Claims, 2 Drawing Sheets

BURNER FOR USE IN A ROTARY DRUM OF A COMBUSTION FURNACE

BACKGROUND OF THE INVENTION

The present invention relates to a burner, particularly for use in a rotary drum of a combustion furnace or incinerator for flowable or fluid, pump-deliverable waste materials, with a lance for introducing the fuel and on whose end a nozzle is placed.

Industrial waste, such as contaminated solvents, polluted oils, dye slurries, defective charges from production processes, etc. are conventionally burnt in rotary furnaces or incinerators. As a function of their consistency, the waste materials are introduced by means of burners, lances or e.g. in drums, the feed means being installed in one end wall of the furnace or incinerator. The end wall is fixed and is conventionally only connected by a gastight seal with the rotating rotary furnace.

Waste incineration plants according to the rotary furnace or incinerator process are conventionally designed in accordance with the expected thermal stressing of said incinerator or furnace. However, as the calorific value of pumpable waste liquids can vary within wide limits, the heat liberated during the burning of said liquids also varies, as does the thermal stressing of the rotary drum. Difficulties of this type more particularly occur if drums with flammable waste liquids are fed into the drum. The function of the burner is in general to stabilize the fluctuations of the furnace or incinerator output. As the pump pressure for delivering the liquid and pasty waste can only be varied within narrow limits, the temperature-resistant lining of the rotary drum is subject to strong local temperature variations, which greatly reduces the life thereof.

DE-OS No. 31 01 244 discloses a furnace of the aforementioned type, which is designed for smaller plants and is constructed as a combined combustion and melting furnace for solid, doughy and liquid waste materials with a drum diameter of less than 2 m. For space reasons, it is not possible in the case of such a furnace, to arrange all the units for supplying the waste to be burnt in the same furnace end wall. Thus, in said furnace the apparatus for feeding in drums is positioned in one end wall and the burner for the flowable, liquid or doughy waste materials, which can be delivered with a pump is arranged in the other end wall. The two end walls are not fixed to the drum and the latter can be pivoted backwards and forwards about its axis. The burner is constructed in such a way that in its longitudinal axis it can be inserted into or removed from the furnace, so that it can always be brought into the vicinity of the waste materials to be burnt.

SUMMARY OF THE INVENTION

The problem of the present invention is to develop a burner, which is particularly suitable for the operation of such a furnace as aforesaid by means of which, apart from the fuel for a pilot flame, it is possible to introduce other media necessary for maintaining or improving combustion and which is protected in an optimum manner against mechanical and thermal stresses.

A burner characterized by the features of the present invention solves this problem. In accordance with the present invention there is provided a burner, particularly for use in a rotary drum of a combustion furnace or incinerator for flowable, pump-deliverable waste materials, with a lance for introducing the fuel, at whose end is positioned a nozzle, wherein the lance is surrounded by a first uncooled lining. Advantageous further features of the present invention will appear hereinafter.

The burner of the present invention makes it possible to feed to the furnace or incinerator the burner air and the combustion air necessary for the barrels in the furnace in a separately controlled manner, in such a way that the combustion air acts directly on the barrels.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS

Figure 1:
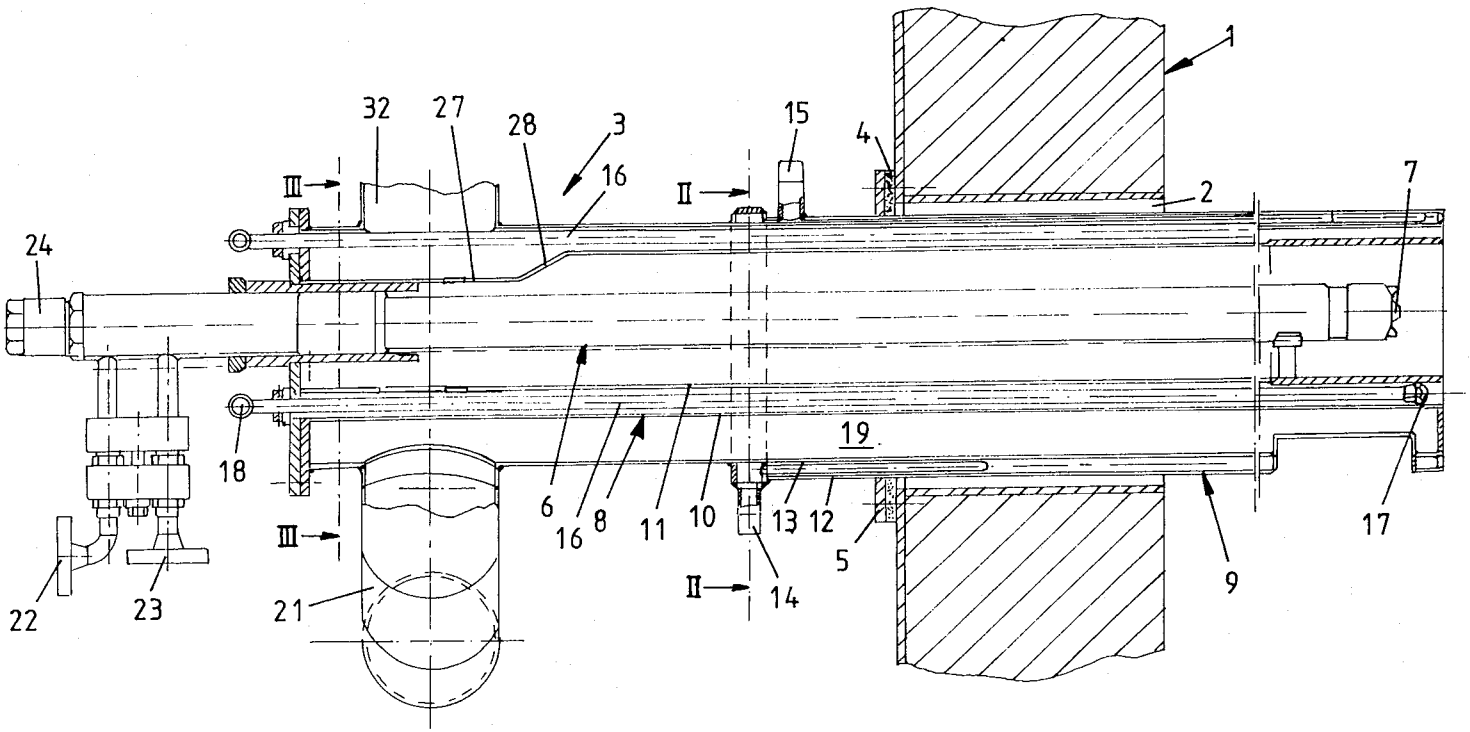
FIG. 1 is a longitudinal section through a burner of the present invention for a combustion furnace or incinerator.

FIG. 1 partly shows an end wall 1 of a not further shown burner connecting piece of a drum of a combustion furnace or incinerator. An opening 2 in said end wall 1 is traversed by a burner 3, held by a ring flange 5 mounted on a seal or packing 4.

Burner 3 essentially comprises a nozzle 7 placed on the end of a lance 6, a first, hereinafter described lining 8, which surrounds the lance 6 and the nozzle 7 in a fixed arrangement coaxial thereto, as well as a second, hereinafter described lining 9, which surrounds the first lining 8 in a fixed arrangement with respect thereto. The first, inner lining 8 essentially comprises two tubular and coaxial jacket parts 10, 11, which are not frontally interconnected at the end thereof adjacent to nozzle 7, so that said first lining is open on the incinerator side and is not water-cooled. The second, outer lining is water-cooled and essentially comprises an external, tubular jacket part 12 and an internal jacket part 13, which are interconnected at their two ends by in each case one, not shown front part, so as to form a container for the water. Connecting pieces 14, 15 for the supply and removal of cooling water are provided. The two linings extend over essentially the same length into the incinerator and lance 6 is arranged in such a way that the nozzle 7 is surrounded by it. Thus, lance 6 and nozzle 7 are protected against mechanical and thermal effects of the incinerator by two linings. In the intermediate part between the two jackets 10, 11 of the first, internal lining 8 are provided four water pipes 16 which are axially parallel thereto and which at the end thereof adjacent to nozzle 7 are provided with in each case one atomizer nozzle 17 and at the other end thereof with in each case one connecting piece 18 for the supply of water. With the aid of said water pipes and through said atomizer nozzle 17, it is possible to atomize and inject water into the incinerator.

By means of a pipeline 32, through the remaining gap between the two jacket parts 10, 11 of the first, internal lining 8, the burner air required for operating the burner is introduced into the incinerator in the vicinity of nozzle 7 and approximately coaxially thereto. The combustion air required e.g. for burning waste materials is introduced between the two linings 8, 9, i.e. between the jacket parts 10, 13 into the incinerator. This separate introduction of the burner air and the waste material combustion air is a reason why these two air supplies are arranged eccentrically to one another, so that there are fewer interactions between the two air flows.

Figure 2:
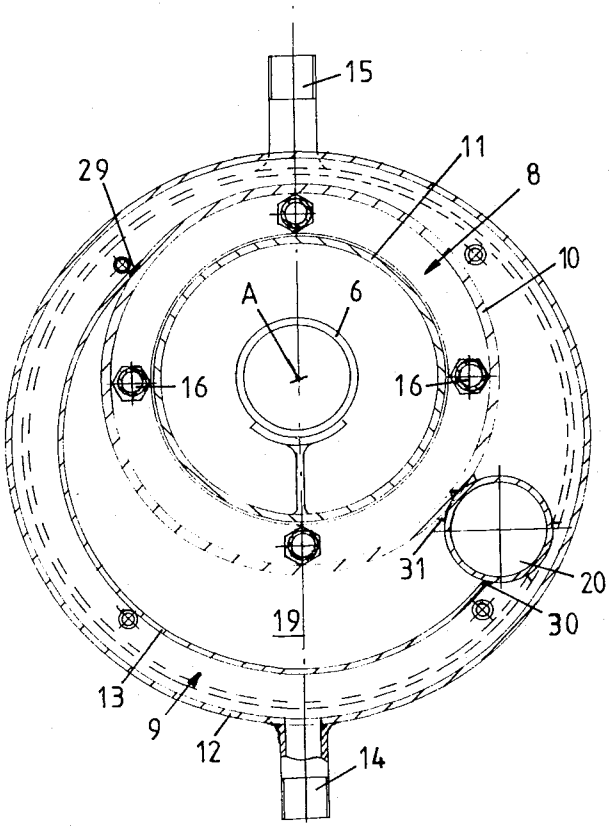
FIG. 2 is a larger-scale cross-section through the burner along line II—II of FIG. 1.

FIG. 2 shows that lance 6 and the first lining 8 are coaxial to one another and are positioned in an axially parallel, but eccentric manner with respect to the second lining 9. In the case of an incinerator drum diameter in the order of magnitude of 1–2 m, the displacement of axis A of lance 6 and consequently nozzle 7 is approximately 30–80 mm.

In the gap 19 between the two linings 8, 9, or between the outer jacket part 10 of the first lining 8 and inner jacket part 13 of the second lining 9 is located a pilot burner lance 20, optionally provided with a not shown nozzle. Other, not shown pipelines can also be arranged in said gap 19, e.g. for slurries, quenching water, etc. The necessary combustion air is supplied to the incinerator via pipelines 21 and through the aforementioned gap 19.

Figure 4:
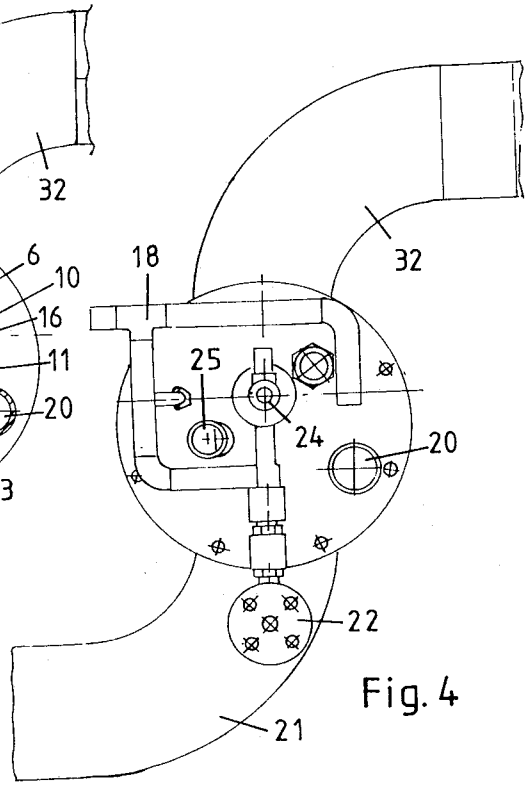
FIG. 4 is a rear view of the burner according to FIG. 1.
Figure 3:
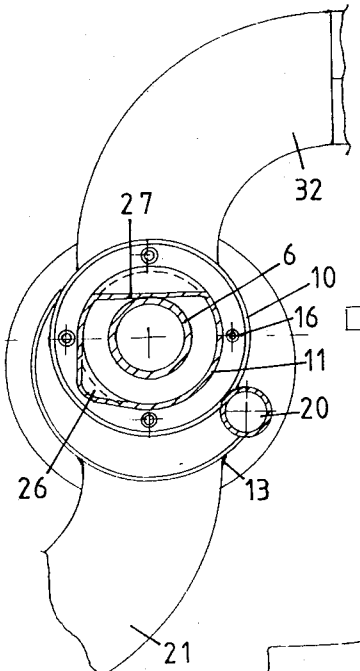
FIG. 3 is a smaller-scale cross-section through the burner along line III—III in FIG. 1.

FIG. 4 is a view of the back of burner 3, while FIG. 1 also shows the pipes 22, 23, 24 used for feeding in fuels, as well as water and optionally additives. It is also possible to see point 25, where it is possible to position a photoelectric cell for monitoring the burning process. The optical path from the inside of the incinerator or from nozzle 7 to said photoelectric cell is obtained in that the inner jacket part 11 of the first lining 8 has a corresponding bulge 26 diverging from the shape of a cylindrical pipe (FIG. 3). For flow reasons, the inner jacket part 11 of the first lining 8 is provided in the vicinity of the air supply with a flattened portion 27 (FIGS. 1 and 3), which passes via a sloping surface 28 (FIG. 1) into the pipe shape (FIG. 2).

FIGS. 2 and 3 show that the inner jacket part 13 of the second lining 9 does not extend as a single part over the entire periphery of the lining. As a result of the eccentric arrangement both of the first lining 8 and of the pilot burner lance 20 with respect to the second lining, it is possible to weld the inner jacket part 13 of the second lining 9 at welds 29, 30 to the outer jacket part 10 of the first lining 8 or to lance 20 of the pilot burner. To complete the elongated gap between the two linings 8, 9, lance 20 is also welded to the outer jacket part 10 of the first lining 8 at weld point 31. This saves both material and weight.

Such a burner can be used in a very flexible manner and is largely protected against damage. It enables any medium to be fed to the point where it is required for combustion. This burner is not only intended for use in rotary furnaces, but can be used in other furnaces as well. The process according to the invention describes the special advantages of introducing the burner air and the combustion air together with a burner.

What is claimed is:

1. A burner, particularly for use in a rotary drum of a combustion furnace or incinerator for flowable, pump-deliverable waste materials which comprises a lance for introducing fuel having an end, a nozzle positioned at said end, a first non-water cooled lining surrounding said lance, said first lining comprising two tubular and coaxial jacket parts for guiding burner air to the nozzle, said two parts including an outer jacket part and an inner jacket part, a second water-cooled lining surrounding the first lining, the second lining essentially comprising an outer tubular jacket part and an inner jacket part, and said inner jacket part of said second lining forming together with the outer jacket part of the first lining a gap for guiding combustion air to the combustion furnace.

2. A burner according to claim 1 wherein the first and second linings are essentially of the same length and the lance is arranged therein in such a way that the nozzle is surrounded by said linings.

3. A burner according to claim 1 wherein the lance and the first lining are coaxial to one another and are axially parallel, but eccentrically positioned with respect to the second lining.

4. A burner according to claim 3 wherein the outer jacket part of the second lining is positioned coaxially to the drum.

5. A burner according to claim 3 wherein the inner jacket part of the second lining is at least welded to the outer jacket part of the first lining.

6. A burner according to claim 1 wherein a second lance of a second burner is arranged parallel to said lance for introducing the fuel and the outer jacket part of the first lining and the inner jacket part of the second lining being welded to the lance of the second burner in order to form said gap.

7. A burner according to claim 1 wherein at least one water pipe having an atomizer nozzle for water is arranged in the first lining.

8. A burner according to claim 1 including means for introducing the burner air required for operating the burner into the furnace between the jacket parts in the vicinity of the nozzle and approximately coaxially thereto.

9. A burner according to claim 1 wherein the gap between said first and second linings introduces the combustion air required for burning the waste materials.

10. A burner according to claim 1 including a photoelectric cell and wherein the inner jacket part of the first lining has a bulge for providing an optical path from the interior of the furnace to said photoelectric cell for monitoring the burning process.

11. A burner according to claim 1 wherein the inner jacket part of the first lining has a flattened portion.

* * * * *